US005758592A

United States Patent [19]

Benson, Jr.

[11] Patent Number: 5,758,592

[45] Date of Patent: Jun. 2, 1998

[54] UNDERSEA VEHICLE PROPULSION AND ATTITUDE CONTROL SYSTEM

[75] Inventor: Robert A. Benson, Jr., Saunderstown, R.I.

[73] Assignee: The United States of America as represented by the Secretary of the Navy, Washington, D.C.

[21] Appl. No.: 914,019

[22] Filed: Aug. 12, 1997

[51] Int. Cl.[6] ..... B63G 8/14

[52] U.S. Cl. ..... 114/330; 114/151

[58] Field of Search ..... 114/330, 331, 114/144 R, 150, 151, 337, 338; 440/38, 39

[56] References Cited

U.S. PATENT DOCUMENTS 917,201 4/1909 Vollmer ..... 114/151

2,330,674 9/1943 Briggs ..... 114/151

2,963,543 12/1960 Link et al. ..... 114/151

*Primary Examiner*—Stephen Avila

*Attorney, Agent, or Firm*—Michael J. McGowan; Robert W. Gauthier; Prithvi C. Lall

[57] ABSTRACT

An undersea vehicle propulsion and attitude control system is used to control the forward/reverse movement, vertical up/down movement, lateral movement, pitch, roll and yaw of an undersea vehicle. The propulsion and attitude control system includes a forward port at a forward end of the undersea vehicle, an aft port at an aft end of the vehicle, and radial ports extending radially along the undersea vehicle. The propulsion and attitude control system further includes a single pump, either reversible or unidirectional, and a plurality of valves that, through a controller, selectively control fluid flow between the pump and the forward port, aft port, and radial outlet ports in the undersea vehicle, to provide accurate vehicle propulsion and attitude control.

20 Claims, 4 Drawing Sheets

UNDERSEA VEHICLE PROPULSION AND ATTITUDE CONTROL SYSTEM

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates to vehicle propulsion systems and more particularly, a system for controlling both propulsion and attitude or orientation of an undersea vehicle.

(2) Description of the Prior Art

Undersea vehicles are commonly used in the ocean and other underwater environments for exploration, warfare, and other purposes. The movement and orientation of these undersea vehicles, particularly unmanned undersea vehicles, must be precisely controlled. Unlike surface vessels which generally move within a single plane on the surface of the water, undersea vehicles must be capable of moving in multiple planes and require a system that controls movement in more "degrees-of-freedom" than that used on surface vessels. In addition to lateral movement, undersea vehicles have a component of movement in the vertical direction.

Typical undersea vehicles are operated at various speeds in various directions (e.g. lateral, vertical, forward and reverse) by controlling the propulsion of the vehicle in those directions. An undersea vehicle must also be capable of changing directions by controlling the attitude or orientation of the undersea vehicle, for example, the pivoting of the vehicle up or down within a vertical plane (known as "pitch") and the pivoting of the vehicle from side to side within a horizontal plane (known as "yaw").

To accomplish the additional movement, prior art undersea vehicles have used numerous separate motors and propulsors or propulsion devices. For example, controlling the propulsion and attitude of the vehicle is typically achieved through the use of forward and aft thruster pairs and a propulsion motor/propulsor combination. A total of five separate motors and propulsors are often used to control the lateral, vertical, forward and reverse motion of conventional undersea vehicles. Such a large number of electrical motors occupies a considerable volume of the undersea vehicle and generates an undesirable amount of noise.

SUMMARY OF THE INVENTION

One object of the present invention is a system for precisely controlling the propulsion of an undersea vehicle and the attitude or orientation of the undersea vehicle in numerous planes or degrees of freedom.

A further object of the present invention is a system for controlling propulsion and attitude of an undersea vehicle that requires less space on the undersea vehicle, generates less noise, and is less expensive.

The present invention features an underwater vehicle propulsion and attitude control system that comprises a pump disposed in an underwater vehicle. A forward port is disposed at a forward end of the underwater vehicle, and a forward port conduit fluidly connects the forward port to the pump. An aft port is disposed at an aft end of the underwater vehicle, and an aft port conduit fluidly connects the aft port to the pump. A plurality of radial outlet ports are disposed radially in the underwater vehicle between the forward end and aft end, while a radial port conduit fluidly connects the plurality of radial ports to the pump. A plurality of valves are connected between the pump, the aft port conduit, the forward port conduit, and the radial port conduit, for selectively controlling fluid flow out of the aft, forward, and plurality of radial ports, thereby controlling propulsion and attitude of the underwater vehicle.

The forward port and aft port preferably extend generally along a longitudinal axis of the undersea vehicle. Fluid discharged through the aft port and forward port cause forward and reverse motion, respectively, of the undersea vehicle in a direction generally along the longitudinal axis of the undersea vehicle. Each of the plurality of radial outlet ports extend along radial lines generally orthogonal to the longitudinal axis of the undersea vehicle. Fluid discharged from the plurality of radial outlet ports causes movement of the undersea vehicle in a radial direction generally orthogonal to the longitudinal axis of the undersea vehicle.

In one embodiment, the pump is a reversible pump having a first inlet/outlet connected to the aft port conduit and a second inlet/outlet connected to the forward port conduit. According to this embodiment, the plurality of valves include a first valve connected to the aft port conduit, for controlling fluid flow between the aft port and the first inlet/outlet of the pump; a second valve connected between the aft port conduit and the forward port conduit, for controlling fluid flow between the second inlet/outlet and the aft and forward port conduits; a third valve connected between the radial outlet port conduit and the first inlet/outlet of the pump, for controlling fluid flow between the plurality of radial outlet ports and the first inlet/outlet of the pump; and a fourth valve connected between the radial outlet port conduit and the second inlet/outlet of the pump, for controlling fluid flow between the plurality of radial outlet ports and the second inlet/outlet of the pump.

In another embodiment, the pump is a unidirectional pump having an inlet connected to the forward port conduit and an outlet connected to the aft port conduit. In this embodiment, the plurality of valves include: a first valve connected to the aft port conduit, for controlling fluid flow between the aft port and the outlet of the pump; a second valve connected between the aft port conduit and the forward port conduit, for controlling fluid flow between the inlet of the pump and the aft and forward port conduits; a third valve connected between the forward port conduit and the inlet of the pump, for controlling fluid flow between the forward port conduit and the pump; and a fourth valve connected between the radial outlet port conduit and the forward port conduit, for controlling fluid flow between the radial outlet port conduit and the forward port conduit.

The plurality of radial outlet ports preferably include forward radial outlet ports disposed proximate the forward end of the undersea vehicle and aft radial outlet ports disposed proximate the aft end of the undersea vehicle. The plurality of radial outlet ports also include at least a first pair of radial outlet ports disposed on opposite sides of the undersea vehicle along a first radial line and at least a second pair of radial outlet ports disposed on opposite sides of the undersea vehicle along a second radial line generally orthogonal to said first radial line.

BRIEF DESCRIPTION OF THE DRAWINGS

These and other features and advantages of the present invention will be better understood in view of the following description of the invention taken together with the drawings wherein like reference numerals refer to like parts and wherein.

DESCRIPTION OF THE PREFERRED EMBODIMENT

Figure 1:
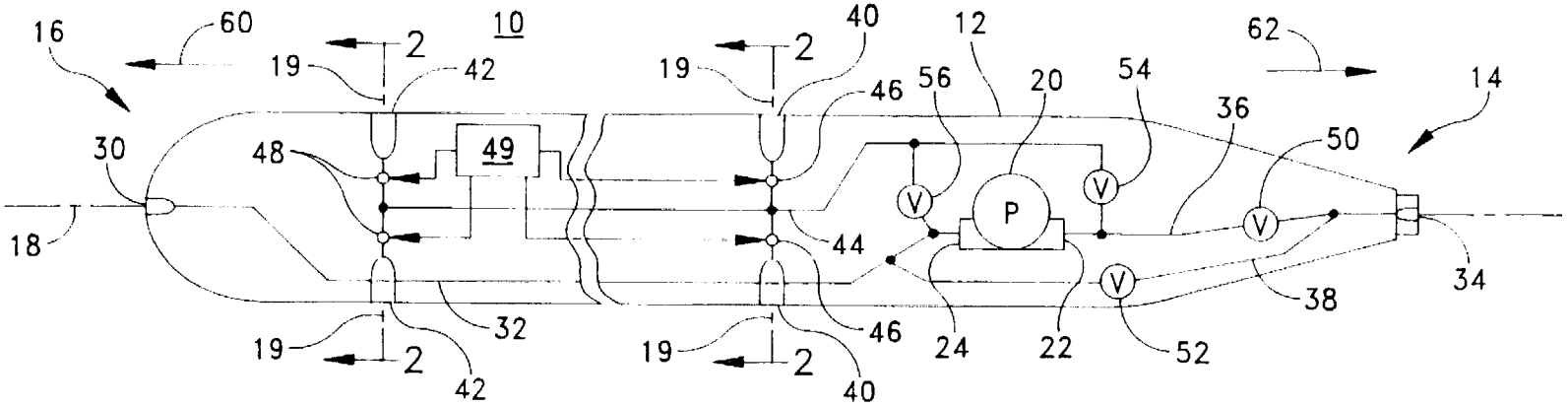
FIG. 1 is a side schematic view of an undersea vehicle propulsion and attitude control system according to one embodiment of the present invention.

An undersea vehicle propulsion and attitude control system 10, FIG. 1, according to the present invention, is used in an undersea vehicle 12, such as, but not limited to, an unmanned undersea vehicle, to control the motion of the undersea vehicle 12 in multiple planes or "degrees of freedom". The undersea vehicle 12, such as a torpedo or other unmanned undersea vehicle, preferably includes a generally cylindrical body having an aft end 14, a forward end 16 and a longitudinal axis 18. The present invention contemplates using the propulsion and attitude control system on other types of undersea vehicles having various shapes.

The propulsion and attitude control system 10 includes a fluid medium pumping device referred to herein as pump 20, such as a motor/pump jet, disposed in the undersea vehicle 12 that receives and discharges a fluid medium, such as sea water. Typically, the pump 20 is a water pump, such as the type used in recreational jet skis, that is driven by an electric motor and produces about 300–600 lbs. of thrust.

In the first embodiment, the pump 20 is reversible and includes at least a first inlet/outlet 22 and at least a second inlet/outlet 24, both of which take in the fluid medium or discharge the fluid medium depending upon the direction in which the pump is operating. An example of a reversible motor/pump combination is disclosed further in U.S. Pat. No. 5,607,329 to Cho et al. and U.S. patent application Ser. No. 08/649,971 (Attorney Docket No. N.C. 77314) filed on May 1, 1996, now U.S. Pat. No. 5,702,273 issued Dec. 30, 1997, entitled A Marine Propulsion System for Underwater Vehicles, and incorporated herein by reference.

The propulsion and attitude control system 10 further includes at least one forward port 30, at least one aft port 34, and a plurality of radial outlet ports 40, 42 fluidly coupled to the pump 20. A plurality of valves 50–56 control fluid flow from the pump 20 through the respective ports. By opening and closing selected valves 50–56, the propulsion and orientation of the undersea vehicle 12 is controlled in the forward, reverse, lateral and vertical directions, as will be described in greater detail below.

The forward port 30 is disposed at the forward end 16 of the undersea vehicle 12, preferably but not necessarily along the longitudinal axis 18. A forward port conduit 32 fluidly connects the forward port 30 to the second inlet/outlet 24 of the pump 20. The forward port 30 acts as an inlet for the fluid medium when the undersea vehicle 12 moves in a forward direction indicated by arrow 60 along the longitudinal axis 18, and as an outlet when the undersea vehicle 12 moves in a reverse direction indicated by arrow 62, as described in greater detail below.

The aft port 34 is disposed in the aft end 14 of the undersea vehicle 12, preferably along the longitudinal axis 18. An aft port conduit 36 fluidly connects the aft port 34 to the first inlet/outlet 22 of the pump 20. The aft port 34 also acts as either an inlet or outlet for the fluid medium depending upon the desired motion of the undersea vehicle 12.

The plurality of radial outlet ports 40, 42 are disposed radially in the undersea vehicle 12 between the forward end 16 and the aft end 14, preferably along radial lines 19. A radial outlet port conduit 44 fluidly connects the plurality of radial outlet ports 40, 42 to the pump 20. The radial outlet ports 40, 42 discharge fluid to move the undersea vehicle 12 along respective radial lines 19 generally orthogonal to the longitudinal axis 18.

In the embodiment having a reversible pump 20, a first valve 50 is connected to the aft port conduit 36 for controlling fluid flow between the aft port 34 and the first inlet/outlet 22 of the pump 20. A second valve 52 is connected between the forward port conduit 32 and the aft port conduit 36, for example, through an intermediate conduit 38, for controlling fluid flow between the forward port 30 and the aft port 34. A third valve 54 is connected between the radial outlet port conduit 44 and the first inlet/outlet 22 of the pump 20, for controlling flow of the fluid from the pump 20 into the radial outlet port conduit 44 when the first inlet/outlet 22 of the pump 20 is acting as an outlet that discharges the fluid.

A fourth valve 56 is connected between the radial outlet port conduit 44 and the second inlet/outlet 24 of the pump 20, for controlling fluid flow between the pump 20 and the radial outlet port conduit 44 when the second inlet/outlet 24 is acting as an outlet that discharges the fluid (i.e., when the pump 20 is operated in reverse). One example of the valves includes electrically operated solenoid valves. The valves can be opened and closed simultaneously and are preferably timed so that they are open/closed when the pump is stopped or running at a slow speed.

By selectively opening and closing the valves 50–56 and controlling the fluid flow out of the forward port 30, aft port 34, and radial outlet ports 40, 42, the undersea vehicle 12 can be moved in multiple planes of movement or "degrees of freedom", as described in greater detail below The present invention contemplates other combinations or arrangements of valves that provide an equivalent flow of fluid medium from the pump 20 to one or more of forward port 30, aft port 34, and radial ports 40, 42.

One or more radial outlet port control valves 46, 48 can be coupled to each radial outlet port 40, 42 for selectively varying the fluid flow or discharge through each individual radial outlet port 40, 42, for example, by varying the port orifice to act like tunnel thrusters. The propulsion and attitude control system 10 preferably includes a controller 49, such as a standard vehicle linear controller or a non-linear sliding mode controller as is well known in the art, for selectively controlling the valves 50–56 and the radial outlet port control valves 46, 48 and thereby independently controlling the fluid medium discharge through the forward port 30, aft port 34 and each of the radial outlet ports 40, 42. One example of the sliding mode controller includes control software that runs on the vehicle control computer, such as a Unix operating system. Independent control of the radial outlet ports 40, 42 thereby controls the pitch and yaw, hover, and ascent/descent of the undersea vehicle 12, while control of the forward port 30 and aft port 34 controls motion along longitudinal axis 18.

Figure 2:
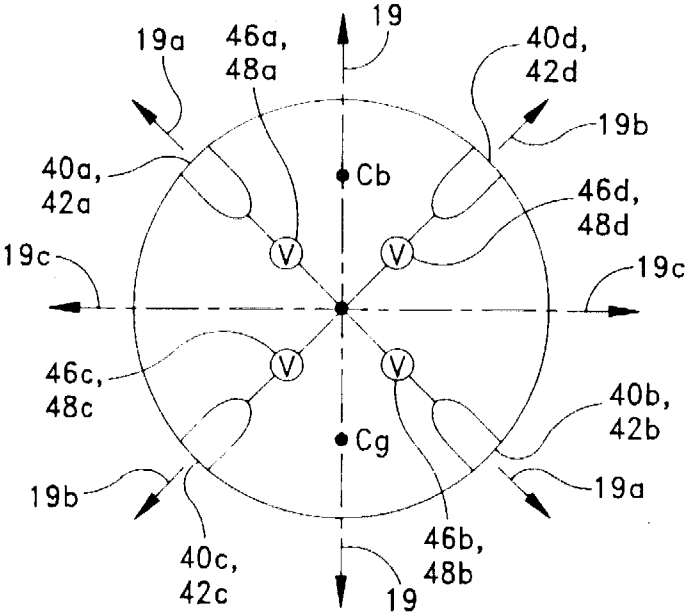
FIG. 2 is a cross-sectional schematic view of the undersea vehicle propulsion and attitude control system taken along line 2—2 in FIG. 1.

In the preferred embodiment, the plurality of radial ports 40, 42 preferably include aft radial ports 40 disposed proximate the aft end 14 of the undersea vehicle 12 and forward radial ports 42 disposed proximate the forward end 16 of the undersea vehicle 12. The sets of radial ports 40, 42 are preferably located at a sufficient distance apart to effectively control the vehicle's pitch and yaw. Each plurality of radial outlet ports 40, FIG. 2, further includes a first pair of radial outlet ports 40*a*, 40*b* disposed on opposite sides of the undersea vehicle 12 along a first radial line 19*a*, and a second pair of radial outlet ports 40*c*, 40*d* disposed on opposite sides of the undersea vehicle 12 along a second radial line 19*b* that is generally orthogonal to the first radial line 19*a*. The undersea vehicle 12 is typical of such vehicles in that the center of buoyancy $C_b$ and the center of gravity $C_g$ are spaced a distance apart along the radial line 19 on opposite sides of the longitudinal axis 18. Such a configuration tends to maintain the radial line 19 oriented in a vertical direction. In the preferred embodiment of FIG. 2, radial lines 19*a*, 19*b* are rotated 45° from radial line 19.

Each of the radial outlet ports 40*a*–40*d* can include a respective control valve 46*a*–46*d*, for selectively controlling the discharge of the fluid and the movement of the undersea vehicle 12 in numerous planes of movement. This allows radial ports 40*a–d* to control pitch, yaw and roll of the undersea vehicle 12. The effect of discharging fluid from radial ports 40*a*, 40*d* is to move the undersea vehicle 12 vertically downward, while discharging from radial ports 40*b* and 40*c* moves the undersea vehicle 12 vertically upward. Similarly, discharging from pairs of radial ports 40*a,c* or 40*b,d* moves the undersea vehicle 12 laterally to the right or left, respectively. To control roll, fluid is discharged from pairs of radial ports 40*a,b* or 40*c,d*. The horizontal and vertical components of the discharges cancel such that the undersea vehicle 12 does not move vertically or laterally. However, due to the offset $C_b$ and $C_g$, the discharges cause unbalanced moments which rotate the undersea vehicle 12. Forward radial ports 42 are configured in a like manner The radial outlet ports 40, 42 and the associated radial outlet port control valves 46, 48 preferably control the undersea vehicle movement, such as the pitch, roll and yaw, at slower speeds. Additional control surfaces/elements, such as rudders and elevators, can be disposed on the surface of the undersea vehicle 12 to further control or aid in the control of the pitch, yaw and roll of the undersea vehicle 12 at higher speeds. It will be understood that the placement of radial ports 40*a*–40*d* can be configured to suit the characteristics of the particular undersea vehicle 12 being used. For example, ports 40*a*–40*d* may be located along radial line 19 and along radial line 19*c* orthongonal to radial line 19.

Figure 3A:
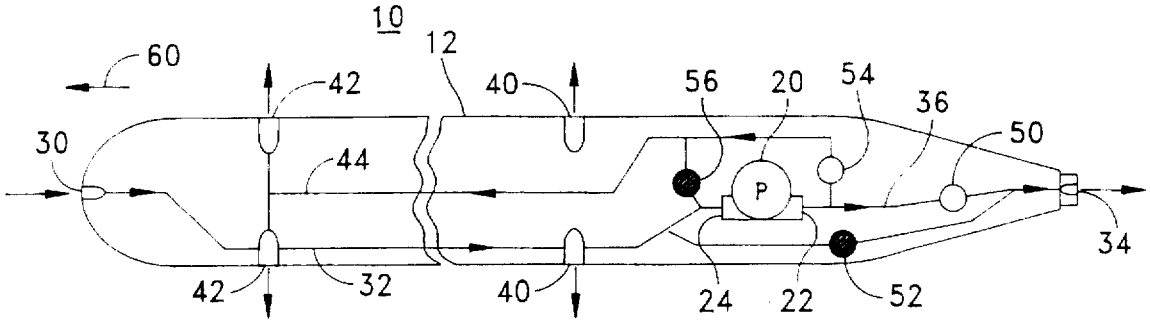
FIG. 3A is a side schematic view of the undersea vehicle propulsion and attitude control system according to the first embodiment of the present invention, for controlling forward motion of the undersea vehicle.
Figure 3B:
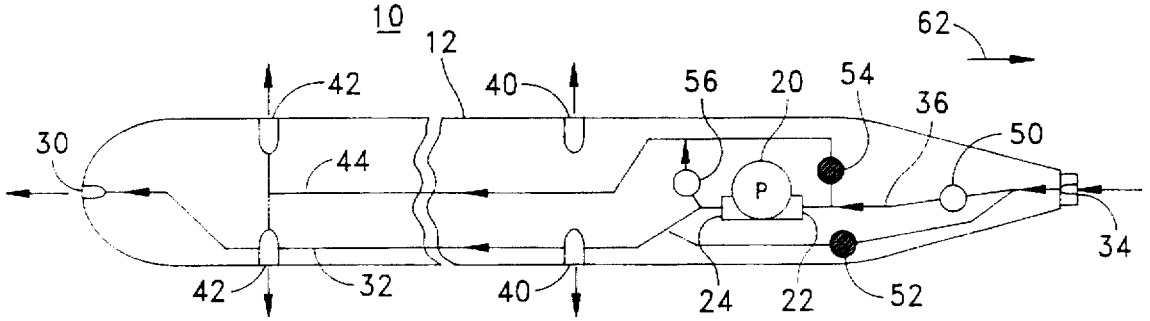
FIG. 3B is a side schematic view of the undersea vehicle propulsion and attitude control system according to the first embodiment of the present invention, for controlling reverse motion of the undersea vehicle.
Figure 3C:
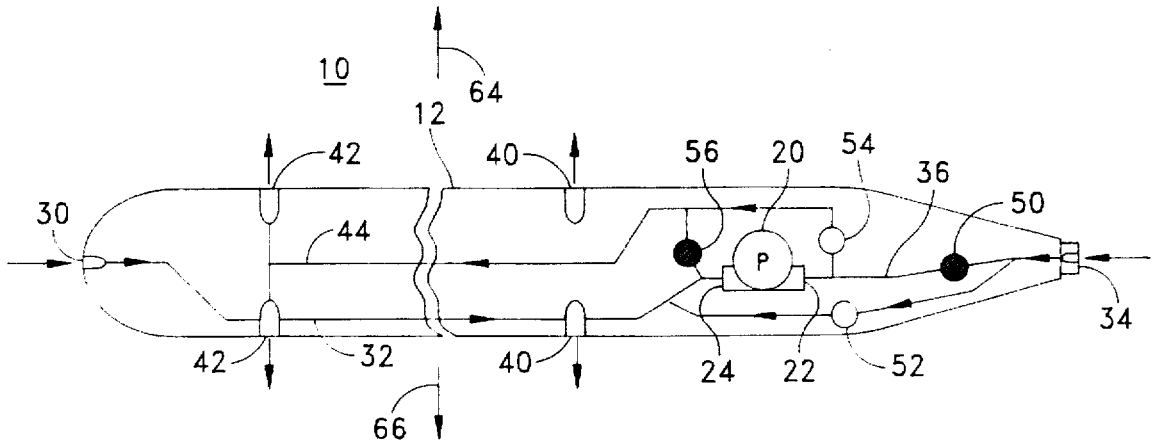
FIG. 3C is a side schematic view of the undersea vehicle propulsion and attitude control system according to the first embodiment of the present invention, for controlling hovering motion of the undersea vehicle.

To operate the present propulsion and attitude control system 10, the plurality of valves 50–56, FIGS. 3A–3C, are selectively opened and closed (opened valves are shown as white and closed valves are shown as black). The valves 50–56 are preferably opened/closed by the vehicle controller 49, e.g., a computerized unit with navigation and attitude control software, as described above with respect to the radial port control valves 46, 48.

To cause forward motion of the undersea vehicle 12, FIG. 3A, generally in the direction of arrow 60, the first valve 50 is opened, the second valve 52 is closed, the third valve 54 is opened, and the fourth valve 56 is closed. The forward port 30 acts as an inlet that receives the fluid medium into the forward port conduit 32. The pump 20 receives the fluid medium from the forward port conduit 32 and discharges the fluid medium through the aft port conduit 36 and open first valve 50. The fluid is then discharged from the aft port 34, creating a rear thrust that moves the vehicle 12 in a forward direction. The open third valve 54 allows the fluid discharged from the outlet 22 of the pump 20 to flow through the radial outlet port conduit 44, thereby allowing the fluid to be discharged through one or more of the radial outlet ports 40, 42, as necessary, to control the direction and orientation of the undersea vehicle 12.

To provide a reverse motion to the undersea vehicle 12, FIG. 3B, generally in the direction of arrow 62, the operation of pump 20 is reversed and the aft port 34 acts as an inlet that receives the fluid medium. The first valve 50 is opened and the second valve 52 is closed so that the fluid received in the aft port 34 is transferred through the aft port conduit 36 to the pump 20 which discharges the fluid medium to the forward port conduit 32 and out of the forward port 30, acting as the outlet. The third valve 54 is closed and the fourth valve 56 is opened so that a portion of the fluid medium discharged from the outlet 24 of the reversed pump 20 is directed to the radial outlet port conduit 44.

To provide a hover motion to the undersea vehicle 12, FIG. 3C, generally in the directions of arrows 64, 66, the first valve 50 is closed, the second valve 52 is opened, the third valve 54 is opened, and the fourth valve 56 is closed. By closing the first valve 50 and opening the second valve 52 between the aft port conduit 36 and forward port conduit 32, both the aft port 34 and forward port 30 act as inlets and the forward and reverse motion is nulled by the pump 20. Opening the third valve 54 allows the fluid medium discharged from the pump 20 from aft and forward port inlets 34, 30, to be directed to the radial outlet port conduit 44, thereby providing nulling movement of the undersea vehicle 12. As discussed above, individual control of the radial outlet ports 40, 42 allows the undersea vehicle 12 to be moved upwardly, downwardly, or laterally to various depths or locations within an undersea environment.

Figure 4:
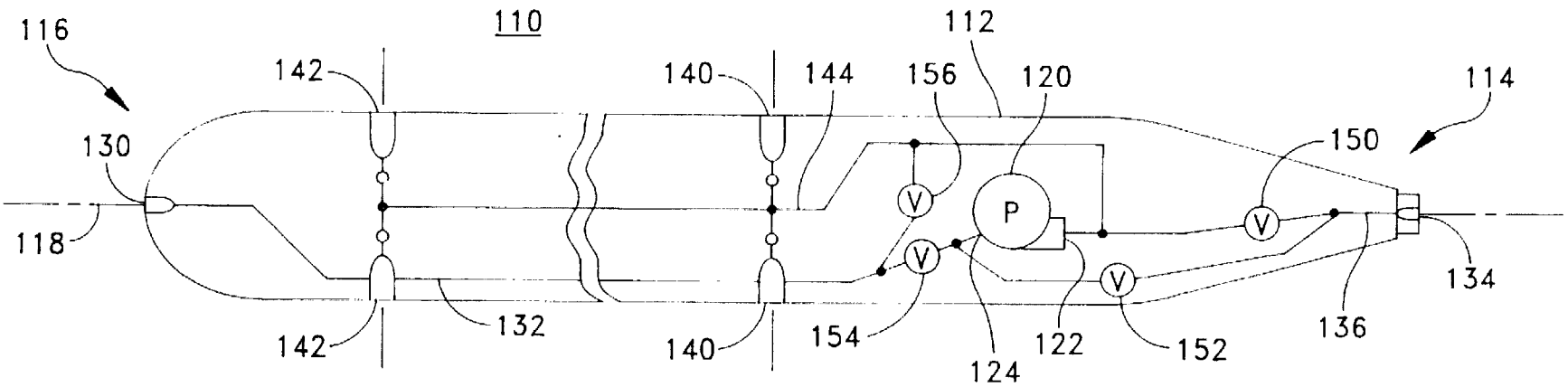
FIG. 4 is a side schematic view of the undersea vehicle propulsion and attitude control system according to a second embodiment of the present invention.

In a second embodiment of the undersea vehicle propulsion and attitude control system 110, FIG. 4, the pump 120 is unidirectional and includes an inlet 124 for receiving the fluid medium and an outlet 122 for discharging the fluid medium. Similar to the first embodiment, a forward port conduit 132 fluidly connects the inlet 124 to a forward port 130. An aft port conduit 136 fluidly connects the outlet 122 to an aft port 134. A radial outlet port conduit 144 fluidly connects the radial outlet ports 140, 142 to the outlet 122 of the pump 120.

This embodiment also includes a first valve 150 connected to the aft port conduit 136 for controlling fluid medium flow between the aft port 134 and the outlet 122 of the unidirectional pump 120, and a second valve 152 connected between the aft port conduit 136 and the forward port conduit 132. In this embodiment, the second valve 152 allows fluid medium received in the aft port 134 to be directed to the inlet 124 of the pump 120.

This embodiment having the unidirectional pump 120 includes a third valve 154 connected between the forward port conduit 132 and the inlet 124 of the pump 120, for controlling fluid medium flow from the forward port 130 to the inlet 124 of the pump 120. A fourth valve 156 is connected between the radial outlet port conduit 144 and the forward port conduit 132, for allowing fluid medium discharged from the pump outlet 122 into the radial outlet port conduit 144 to be directed into the forward port conduit 132.

Figure 5A:
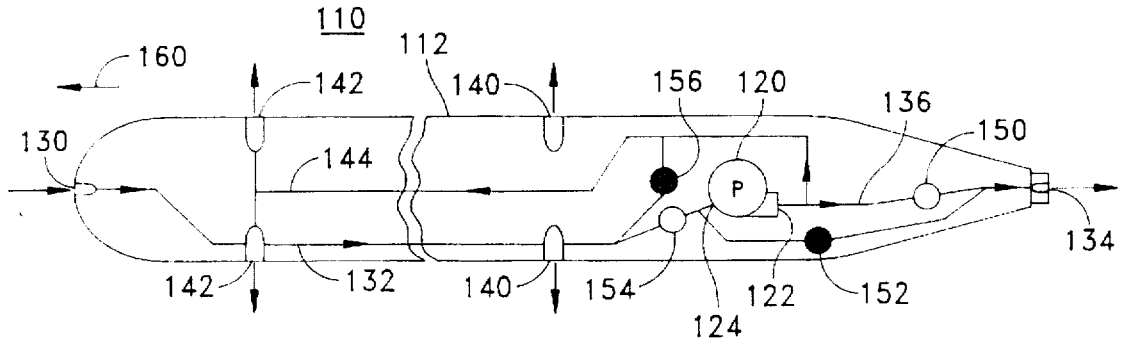
FIG. 5A is a side schematic view of the undersea vehicle propulsion and attitude control system according to the second embodiment for controlling forward motion of the undersea vehicle.
Figure 5B:
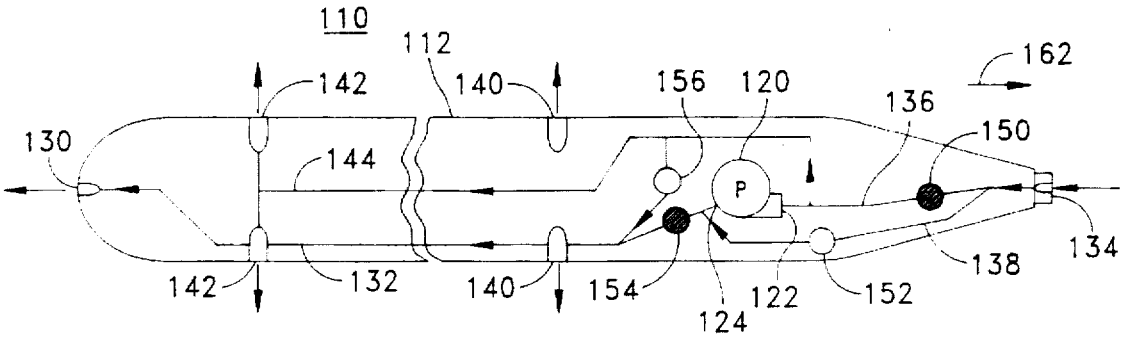
FIG. 5B is a side schematic view of the undersea vehicle propulsion and attitude control system according to the second embodiment for controlling reverse motion of the undersea vehicle.
Figure 5C:
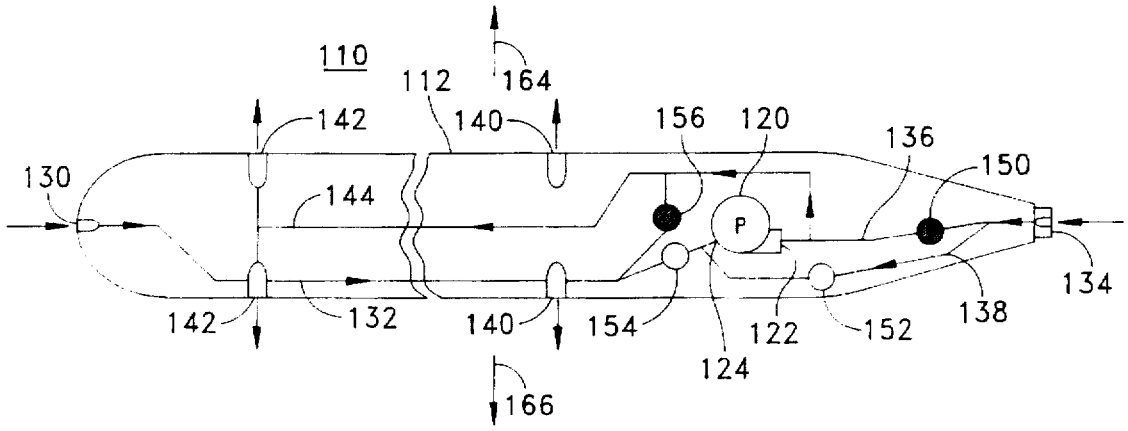
FIG. 5C is a side schematic view of the undersea vehicle propulsion and attitude control system according to the second embodiment for controlling hovering motion of the undersea vehicle.

To provide motion to the undersea vehicle 112, FIGS. 5A–5C, the first, second, third and fourth valves 150–156 are selectively opened and closed. To provide forward motion in the direction of arrow 160, FIG. 5A, the third valve 154 is opened so that fluid medium received into the forward port 130 is passed through the forward port conduit 132 into the inlet 124 of the pump 120. The first valve 150 is opened and the second valve 152 is closed so that the fluid medium discharged from the outlet 122 is directed to the aft port 134, causing a thrust that moves the undersea vehicle 112 in the direction of arrow 160. The fourth valve 156 is closed so that fluid medium discharged from the outlet 122 of the pump 120 is directed into the radial outlet port conduit 144. The fluid medium is then discharged selectively through radial outlet ports 140, 142 to move the undersea vehicle 112 in radial directions or to control pitch, roll and yaw.

To provide reverse motion in the direction of arrow 162, FIG.. 5B, the first valve 150 is closed and the second valve 152 is opened so that fluid medium received in the aft port 134 is directed through the intermediate conduit 138 to the inlet 124 of the pump 120. The pump 120 then discharges the fluid medium through the outlet 122 and into the radial outlet port conduit 144. The fourth valve 156 is opened so that a portion of the fluid medium discharged into the radial outlet port conduit 144 is directed to the forward port conduit 132 and discharged out of the forward port 130, causing the undersea vehicle 112 to move in the reverse direction indicated by arrow 162. The third valve 154 is closed to prevent the fluid medium being discharged through the forward port conduit 132 from being fed back to the pump inlet 124.

To provide a hovering motion (no forward or reverse motion, generally in the direction of arrows 164, 166) the first valve 150, FIG. 5C, is closed, the second valve 152 is opened and the third valve 154 is opened so that fluid medium received in both the forward port 130 and aft port 134 is directed to the inlet 124 of the pump 120, thereby nulling the forward or reverse motion of the undersea vehicle 112. The fluid medium is then discharged to the radial outlet port conduit 144 to the radial outlet ports 140, 142. As described above, the discharge of the fluid medium through each radial outlet port can be selectively controlled to vary the depth of the undersea vehicle 112 or change the pitch or yaw of the undersea vehicle 112 while hovering. The fourth valve 156 is closed to prevent the fluid medium being discharged through the radial outlet port conduit 144 from being directed to the forward port conduit 132.

Accordingly, the undersea vehicle propulsion and attitude control system of the present invention controls the movement of an undersea vehicle in multiple planes, e.g. forward motion, reverse motion, hovering, pitch, roll and yaw, using only a single reversible or unidirectional pump. The propulsion and attitude control system of the present invention thereby reduces the noise generated when moving and changing directions of the undersea vehicle, reduces the amount of space required, reduces the weight of the undersea vehicle as a whole, reduces the cost of the system and allows quicker changes in direction and force.

In light of the above, it is therefore understood that within the scope of the appended claims, the invention may be practiced otherwise than as specifically described.

What is claimed is:

1. An undersea vehicle propulsion and attitude control system comprising:

a pump disposed in an undersea vehicle;

a forward port disposed at a forward end of said undersea vehicle;

a forward port conduit fluidly connecting said forward port to said pump;

an aft port disposed at an aft end of said undersea vehicle;

an aft port conduit fluidly connecting said aft port to said pump;

a plurality of radial outlet ports disposed radially in said undersea vehicle between said forward end and said aft end;

a radial outlet port conduit fluidly connecting said plurality of radial outlet ports to said pump; and a plurality of valves connected between said pump and at least two of said aft port conduits, said forward port conduit and said radial outlet port conduit, the valves controlling fluid discharge out of said aft port, said forward port and said plurality of radial outlet ports for controlling movement of said undersea vehicle in multiple planes.

2. The undersea vehicle propulsion and attitude control system of claim 1, wherein said forward port and said aft port extend generally along a longitudinal axis of said undersea vehicle, and wherein fluid discharge through said aft port and said forward port cause forward and reverse motion, respectively, of said undersea vehicle in a direction generally along said longitudinal axis of said undersea vehicle.

3. The undersea vehicle propulsion and attitude control system of claim 2 wherein:

each of said plurality of radial outlet ports extends along a radial line generally orthogonal to said longitudinal axis of said undersea vehicle; and fluid discharge from said plurality of radial outlet ports is adapted to cause movement of said undersea vehicle in a direction generally orthogonal to said longitudinal axis of said undersea vehicle.

4. The undersea vehicle propulsion and attitude control system of claim 1 wherein said pump is a reversible pump having a first inlet/outlet connected to said aft port conduit and a second inlet/outlet connected to said forward port conduit.

5. The undersea vehicle propulsion and attitude control system of claim 4 wherein said plurality of valves include:

a first valve connected to said aft port conduit, for controlling fluid flow between said aft port and said first inlet/outlet of said pump;

a second valve connected between said aft port conduit and said forward port conduit, for controlling fluid flow between said second inlet/outlet of said pump and said aft port conduit and said forward port conduit;

a third valve connected between said radial outlet port conduit and said first inlet/outlet of said pump, for controlling fluid flow between said plurality of radial outlet ports and said first inlet/outlet of said pump; and a fourth valve connected between said radial outlet port conduit and said second inlet/outlet of said pump, for controlling fluid flow between said plurality of radial outlet ports and said second inlet/outlet of said pump.

6. The undersea vehicle propulsion and attitude control system of claim 5 wherein said first valve is open, said second valve is closed, said third valve is open and said fourth valve is closed, for providing forward motion to said undersea vehicle.

7. The undersea vehicle propulsion and attitude control system of claim 5 wherein said first valve is open, said second valve is closed, said third valve is closed and said fourth valve is open, for providing reverse motion to said undersea vehicle.

8. The undersea vehicle propulsion and attitude control system of claim 5 wherein said first valve is closed, said second valve is open, said third valve is open and said fourth valve is closed, for providing hover motion to said undersea vehicle.

9. The undersea vehicle propulsion and attitude control system of claim 1 wherein said pump is a unidirectional pump having an inlet connected to said forward port conduit and an outlet connected to said aft port conduit.

10. The undersea vehicle propulsion and attitude control system of claim 9 wherein said plurality of valves include:

a first valve connected to said aft port conduit, for controlling fluid flow between said aft port and said outlet of said pump;

a second valve connected between said aft port conduit and said forward port conduit, for controlling fluid flow between said inlet of said pump and said aft port conduit and said forward port conduit;

a third valve connected between said forward port conduit and said inlet of said pump, for controlling fluid flow between said forward port conduit and said pump; and a fourth valve connected between said radial outlet port conduit and said forward port conduit, for controlling fluid flow between said radial outlet port conduit and said forward port conduit.

11. The undersea vehicle propulsion and attitude control system of claim 10 wherein said first valve is open, said second valve is closed, said third valve is open and said fourth valve is closed, for providing forward motion to said undersea vehicle.

12. The undersea vehicle propulsion and attitude control system of claim 10 wherein said first valve is closed, said second valve is open, said third valve is closed and said fourth valve is open, for providing reverse motion to said undersea vehicle.

13. The undersea vehicle propulsion and attitude control system of claim 10 wherein said first valve is closed, said second valve is open, said third valve is open and said fourth valve is closed, for providing hover motion to said undersea vehicle.

14. The undersea vehicle propulsion and attitude control system of claim 1 wherein said plurality of radial outlet ports include a plurality of forward radial outlet ports disposed proximate said forward end of said undersea vehicle and a plurality of aft radial outlet ports disposed proximate to said aft end of said undersea vehicle.

15. The undersea vehicle propulsion and attitude control system of claim 1 wherein said plurality of radial outlet ports includes at least a first pair of radial outlet ports disposed on opposite sides of said undersea vehicle along a first radial line, and at least a second pair of radial outlet ports disposed on opposite sides of said undersea vehicle along a second radial line generally orthogonal to said first radial line.

16. The undersea vehicle propulsion and attitude control system of claim 1 further including a radial outlet port control valve connected to each of said plurality of radial outlet ports, for varying fluid flow out of each of said plurality of radial outlet ports.

17. The undersea vehicle propulsion and attitude control system of claim 16 further including a controller coupled to each said radial outlet port control valve connected to each of said plurality of radial outlet ports, for independently controlling fluid flow out of each of said plurality of radial outlet ports and into and out of said pump.

18. The undersea vehicle propulsion and attitude control system of claim 17 wherein said controller is coupled to each of said plurality of valves, for independently controlling fluid flow out of each of said plurality of valves.

19. The undersea vehicle propulsion and attitude control system of claim 5 further including a controller coupled to each of said plurality of valves, for independently controlling fluid flow out of each of said plurality of valves.

20. The undersea vehicle propulsion and attitude control system of claim 10 further including a controller coupled to each of said plurality of valves, for independently controlling fluid flow out of each of said plurality of valves.

* * * * *